US010329991B2

(12) United States Patent
Lehrbaum et al.

(10) Patent No.: US 10,329,991 B2
(45) Date of Patent: Jun. 25, 2019

(54) THIN FOIL ENCAPSULATED ASSEMBLIES

(71) Applicant: Nelson Global Products, Inc., Stoughton, WI (US)

(72) Inventors: Daniel Lehrbaum, Waukesha, WI (US); Jason Drost, Lake Mills, WI (US)

(73) Assignee: Nelson Global Products, Inc., Stoughton, WI (US)

( * ) Notice: Subject to any disclaimer, the term of this patent is extended or adjusted under 35 U.S.C. 154(b) by 18 days.

(21) Appl. No.: 15/638,753

(22) Filed: Jun. 30, 2017

(65) Prior Publication Data

US 2017/0298804 A1 Oct. 19, 2017

Related U.S. Application Data

(62) Division of application No. 14/467,907, filed on Aug. 25, 2014, now abandoned.

(60) Provisional application No. 61/869,841, filed on Aug. 26, 2013.

(51) Int. Cl.
*F01N 13/14* (2010.01)

(52) U.S. Cl.
CPC ..... *F01N 13/141* (2013.01); *F01N 2610/02* (2013.01); *F01N 2610/1453* (2013.01)

(58) Field of Classification Search
CPC .... F01N 13/141; F01N 13/1844; F01N 3/035; F01N 3/10; F01N 3/20
See application file for complete search history.

(56) References Cited

U.S. PATENT DOCUMENTS

| | | | | |
|---|---|---|---|---|
| 4,441,743 | A * | 4/1984 | Steenbergen | B29C 65/3444 285/21.2 |
| 4,804,210 | A * | 2/1989 | Hancock | F16L 59/20 285/179 |
| 7,730,721 | B2 | 6/2010 | Kimura et al. | |
| 8,756,921 | B2 * | 6/2014 | Troxler | F01N 3/00 60/295 |
| 9,341,097 | B2 * | 5/2016 | Bays | F01N 3/18 |
| 9,664,081 | B2 * | 5/2017 | Rusch | F01N 3/2066 |
| 2002/0100517 | A1 | 8/2002 | Somerville et al. | |
| 2008/0155973 | A1 | 7/2008 | Maruyama et al. | |
| 2008/0302088 | A1 | 12/2008 | Koehler et al. | |
| 2009/0019843 | A1 * | 1/2009 | Levin | B01F 3/04049 60/303 |
| 2009/0084094 | A1 * | 4/2009 | Goss | B01F 3/04049 60/301 |
| 2010/0098604 | A1 * | 4/2010 | Drost | B01F 3/04049 422/225 |
| 2010/0107614 | A1 | 5/2010 | Levin et al. | |
| 2010/0170233 | A1 | 7/2010 | Tangemann et al. | |
| 2010/0170234 | A1 | 7/2010 | Way et al. | |
| 2010/0196225 | A1 * | 8/2010 | Harinath | F01N 3/2066 422/187 |
| 2010/0212292 | A1 | 8/2010 | Rusch et al. | |

(Continued)

FOREIGN PATENT DOCUMENTS

EP 0704651 A1 4/1996

*Primary Examiner* — Beth A Stephan

(74) *Attorney, Agent, or Firm* — Smith Law Office; Jeffry W. Smith

(57) ABSTRACT

An injector tube assembly that includes thin foil insulation around a receiver tube and a relatively rigid housing secured to the thin foil and bearing on tube insulation while also being packed with junction insulation.

7 Claims, 6 Drawing Sheets

(56) References Cited

U.S. PATENT DOCUMENTS

| | | | | |
|---|---|---|---|---|
| 2011/0094206 | A1* | 4/2011 | Liu | F01N 3/2066<br>60/274 |
| 2011/0274590 | A1* | 11/2011 | Floyd | F01N 3/2066<br>422/177 |
| 2012/0174561 | A1* | 7/2012 | Troxler | F01N 3/2066<br>60/274 |
| 2013/0239546 | A1 | 9/2013 | Levin et al. | |

* cited by examiner

THIN FOIL ENCAPSULATED ASSEMBLIES

CROSS REFERENCE TO RELATED APPLICATIONS

This application is a divisional of U.S. application Ser. No. 14/467,907, filed Aug. 25, 2014, which claims the benefit of U.S. Provisional Application No. 61/869,841, filed Aug. 26, 2013, the disclosures of which are incorporated by reference herein.

BACKGROUND

This application discloses an invention which is related, generally and in various embodiments, to thin foil encapsulated insulation assemblies.

In various technologies, effective insulation for providing heat retention is an important design component. One example of a technology in which effective insulation is desired is the field of exhaust after-treatment systems for treatment of harmful exhaust emissions from internal combustion engines. Typical exhaust after-treatment systems are configured to reduce the level of undesirable exhaust byproducts such as nitrogen oxides. Accordingly, conventional exhaust after-treatment systems include a decomposition tube and fitting for an injector designed to inject a urea based diesel exhaust fluid or reductant, which is capable of decomposing into gaseous ammonia and carbon dioxide in the presence of exhaust gas within the tube under certain conditions. After exiting the decomposition tube, exhaust gas flows through a selective catalytic reduction (SCR) system where the ammonia reacts with nitrogen oxides to produce nitrogen and water. The catalytic conversion of nitrogen oxides is highly dependent on temperature, making heat retention through effective insulation a critical design requirement for decomposition tubes.

Insulating both the decomposition tube and the junction with injector module is possible using double walled tubes with insulation disposed in the annular space between an inner tube and an outer tube. Such a junction typically includes the decomposition tube with an integral injector tube to which an injection flange is joined for mounting the injector module. Insulating the junction between the decomposition tube and the injector tube is possible using relatively thick outer tubes and insulation housings that can be welded together at the junction to provide the necessary support and structural rigidity required to transfer loads between the decomposition tube and the injector tube. Nonetheless, double-walled tubes are expensive and add weight to the overall system. To avoid using double-walled systems, foil is used to surround the tube insulation on both the decomposition tube and the injector tube, but little or no insulation is used at the junction between the decomposition tube and the injector tube because there is no outer tube on which to support an insulated junction housing.

Thus, there is a need for a tube junction that can be insulated at relatively low cost and maintain light weight of the assembly.

SUMMARY OF THE INVENTION

The present invention overcomes the deficiencies of prior tube junctions by providing a tube junction housing having; a receptacle portion defining an insulation space; a receptacle portion lip joined to the injector housing and defining an injector flange opening; and a base flange joined to the receptacle portion and including a thin-walled connection surface.

The receptacle housing portion can define an injector tube axis through the injector flange opening and the base flange is substantially arcuate to define a receiver tube axis spaced apart from the base flange, and the injector tube axis and the receiver tube axis are disposed to define an angle of less than 90°.

The receptacle portion lip can define connector openings to allow for screws or bolts to connect an injector tube to a receiver tube. Also, the base flange can extend outwardly from the receptacle portion.

The tube junction housing can further include an injector flange disposed in the tube junction housing adjacent to and substantially co-planar with the injector flange opening.

The tube junction housing can also include insulation disposed in the insulation space.

In another aspect of the invention, an injector tube assembly is provided that includes: a receiver tube defining a longitudinal axis; tube insulation substantially surrounding the receiver tube; and a thin foil spaced apart from the receiver tube and substantially surrounding the tube insulation; an injector tube joined to the receiver tube at a tube junction and defining an injection tube axis; and a tube junction housing at least partially surrounding the tube junction and having; a receptacle portion defining an insulation space, and a receptacle portion lip joined to the receptacle portion and defining an injector flange opening, and a base flange joined to the receptacle portion and including a thin foil connection surface joined to the thin foil and the base flange rests on the tube insulation and is spaced apart from the receiver tube. Junction insulation is preferably disposed in the insulation space and an injection flange can be disposed in the tube junction housing adjacent to the injector flange opening.

The tube junction housing base flange can be substantially arcuate and spaced apart from the receiver tube axis.

The tube junction assembly receptacle portion lip preferably defines connector openings for access by screws, bolts or other connectors to secure an injector module to the injection flange. The base flange can extend outwardly from the receptacle portion to a distance that minimizes bearing pressure on the tube insulation. The assembly can also include an injector flange disposed in the receptacle portion adjacent to and substantially co-planar with the injector flange opening. Preferably, the tube junction assembly also includes insulation disposed in the insulation space.

DETAILED DESCRIPTION OF THE INVENTION

It is to be understood that at least some of the figures and descriptions of the invention have been simplified to illustrate elements that are relevant for a clear understanding of the invention, while eliminating, for purposes of clarity, other elements that those of ordinary skill in the art will understand without illustrations.

Figure 1:
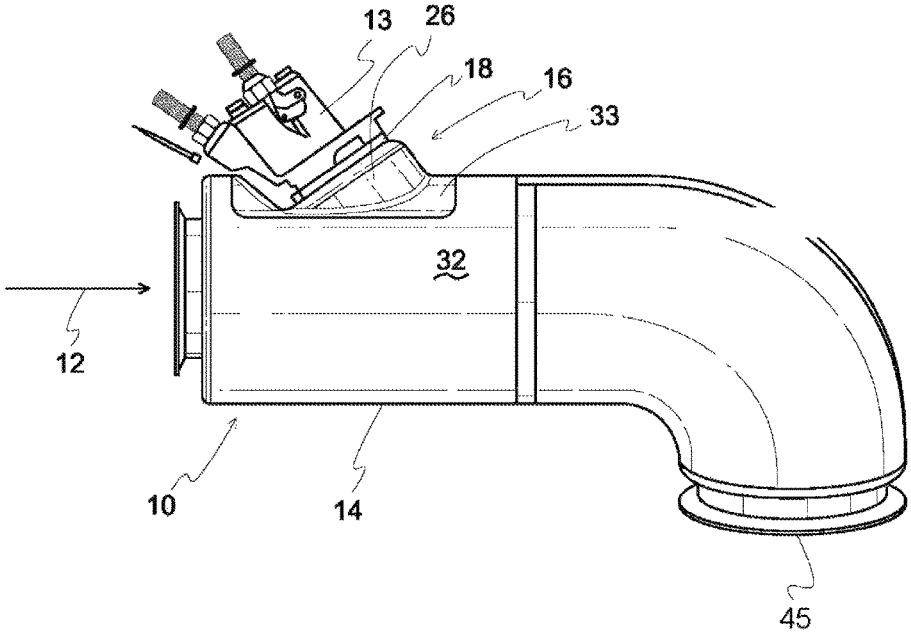
FIG. 1 shows a side view of a decomposition tube and injector module assembly with a tube junction housing in accordance with the present invention.

In particular, and by reference to FIGS. 1 through 4, there is illustrated a partial embodiment of an exhaust after-treatment system 10, which is coupled to an internal combustion engine (not shown). Referring to FIG. 1, part of an after-treatment system 10 is illustrated, which is capable of receiving and treating exhaust gas generated by the engine as indicated by directional arrow 12. After being treated by the after-treatment system 10, exhaust gas flows out of the, through a decomposition tube outlet end 45 of the after-treatment system 10 and through an SCR assembly (not-illustrated). The embodiments described herein are used in conjunction with an exhaust-after-treatment system, but the present invention is useful in any heat-sensitive system having a receiver tube 14 and an injector tube 15 joined at a junction 17 (FIGS. 3 and 4) to merge or separate two fluid flows.

Figure 2:
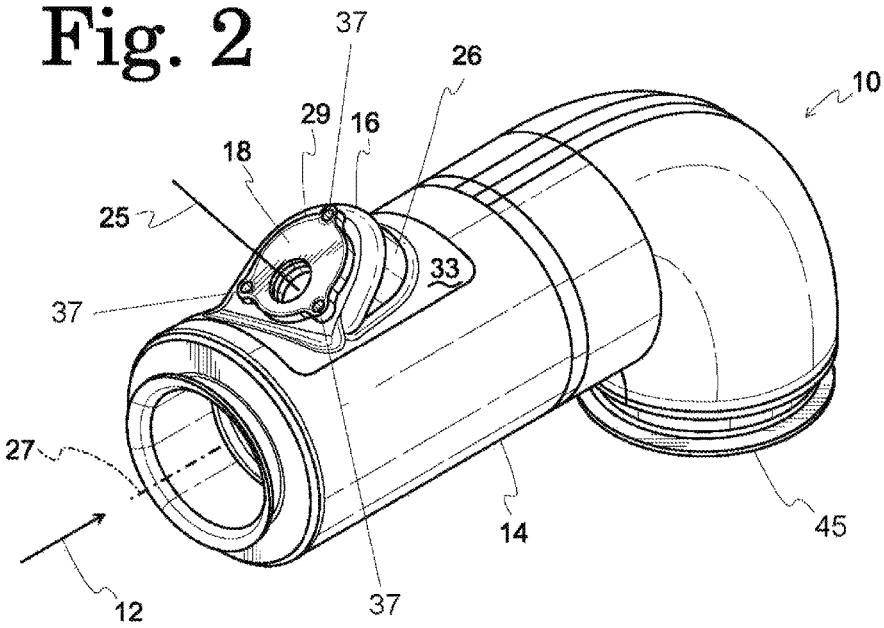
FIG. 2 shows a perspective view of the embodiment of FIG. 1.
Figure 3:
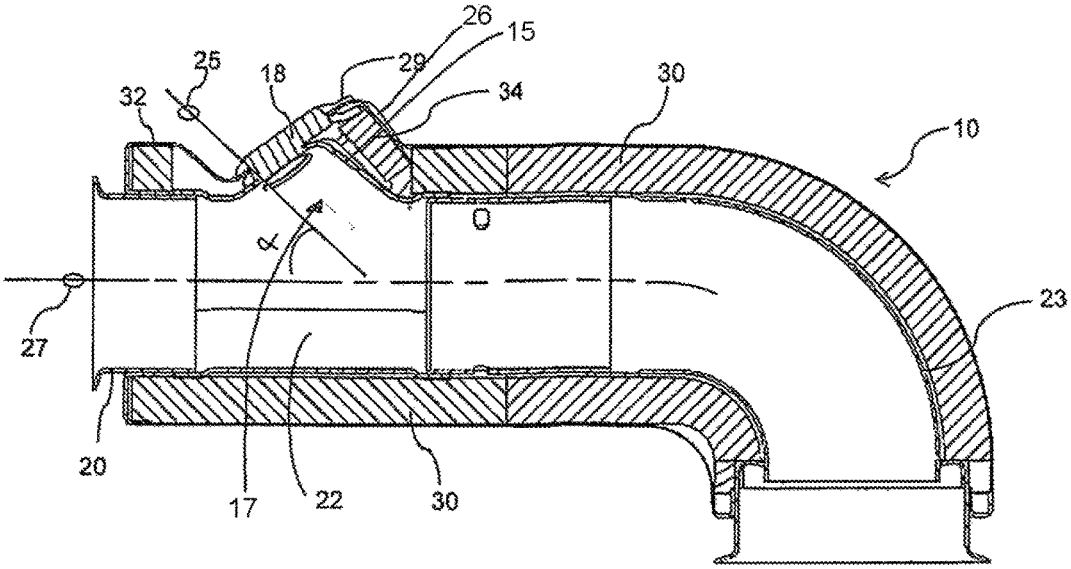
FIG. 3 shows a cross-sectional view of the embodiment of FIG. 1.
Figure 4:
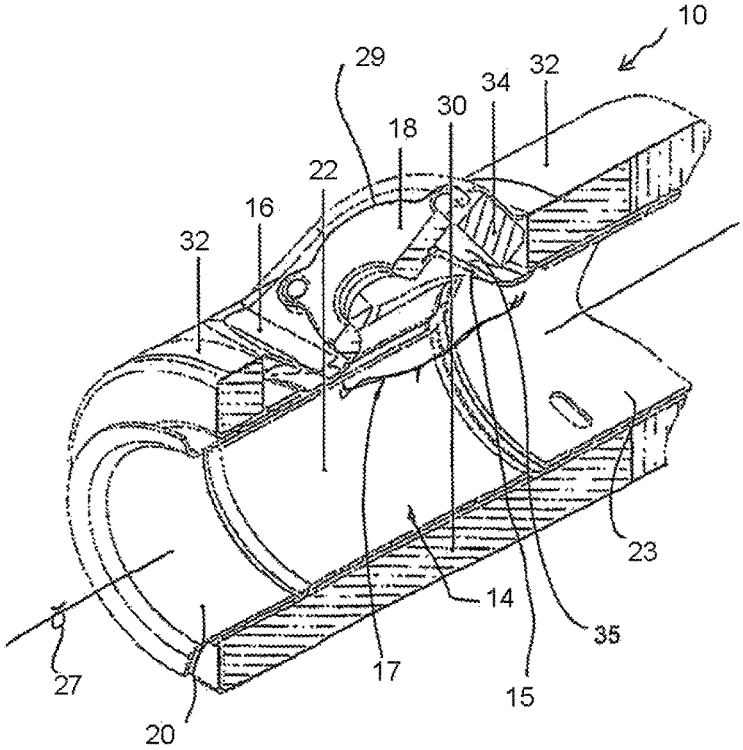
FIG. 4 shows a partial cross-sectional perspective view of the embodiment of FIG. 1.
Figure 9:
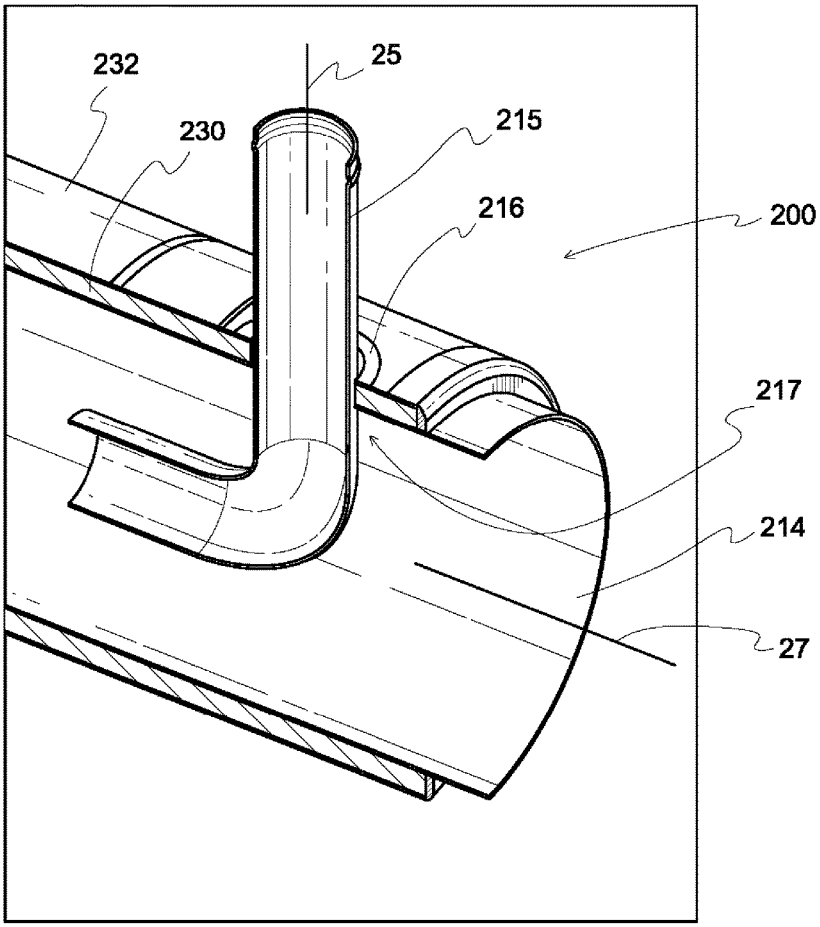
FIG. 9 shows a perspective cross-sectional view of an insulated aspirator tube assembly with thin foil encapsulation according to an alternative embodiment.
Figure 10:
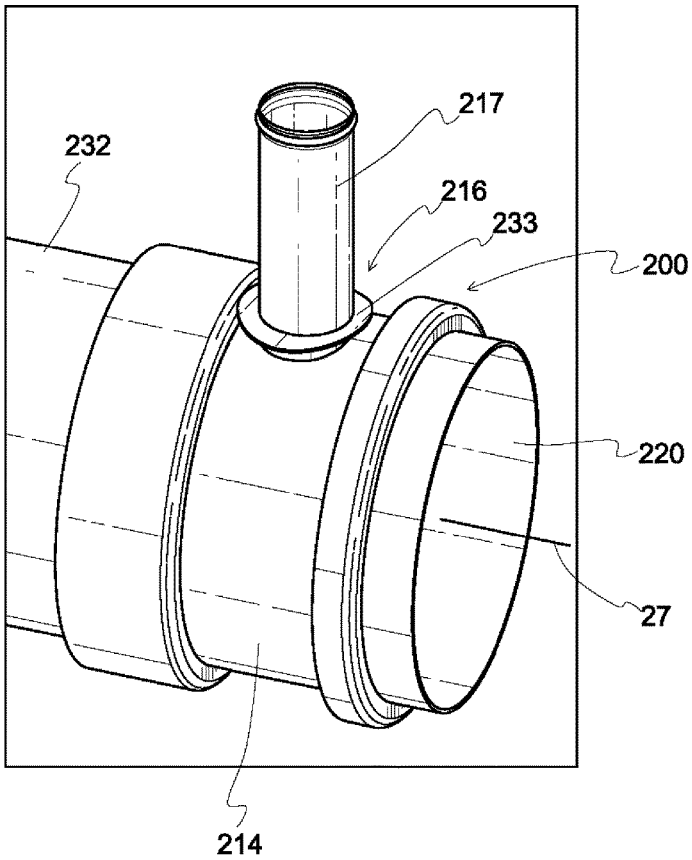
FIG. 10 shows a perspective view showing the assembly of FIG. 9 with a tube junction housing around the aspirator tube for affixing thin foil.

The after-treatment system 10 includes a receiver tube 14, in this case a decomposition tube, an injector tube 15, and a tube junction housing that in the illustrated embodiment is a reductant injector housing 16. A reductant injector module 13 (seen in FIG. 1, but only the injector flange 18 is shown in FIGS. 2 through 4 for clarity) is coupled to a reductant supply source (not shown) and injects reductant past the injector flange 18, through the injector tube 15, and into the decomposition tube 14. The injector flange 18 is either welded directly to the injector tube 15 or is integral with and cast from the same material as the injector tube 15 and the decomposition tube 14. In the straight decomposition tube 14 embodiment shown in FIGS. 1 through 4, the decomposition tube 14 is substantially cylindrically shaped with an elbow at the outlet end 45, but other shapes, particularly different cross-sectional shapes are possible. Referring to FIG. 2, the decomposition tube 14 includes an inlet 20 to the tube, an inlet tube 22 and an outlet tube 23. The injector tube 15 defines an injector tube axis 25 (FIGS. 2 and 3) that extends outwardly at an angle relative to a receiver tube axis 27. Preferably, an angle a between the two axes 25 and 27 is less than 90°, but other angles can be used, as seen in FIGS. 9 and 10, for example.

As shown in FIGS. 1 through 7, the reductant injector housing 16 includes a base flange 24 and receptacle portion 26 extending outwardly at an angle from the base flange 24. The receptacle portion 26 at least partially surrounds the junction 17 and includes a through-hole portion 28 sized and shaped to expose the injector flange 18 to allow connection of the injector module 13. A receptacle portion lip 29 lays over, but is not connected to the injector flange 18. Cut-outs 31 allow access for bolt holes 37 in the injector flange 18 to be exposed for connecting. While the illustrated embodiment depicts a three bolt hole arrangement, any suitable number of bolt holes can be used, and other suitable connectors and arrangements are possible.

Figure 11:
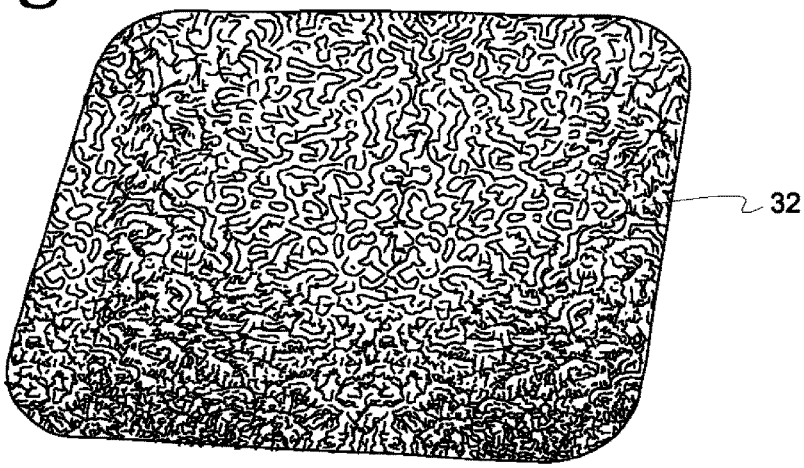
FIG. 11 is a partial perspective view of an embossed thin foil used in conjunction with the present invention.

Referring to FIGS. 3 and 4, the decomposition tube 14 is surrounded by a layer of tube insulation 30 which is then encapsulated by a layer of thin foil 32. Junction insulation 34 is preferably provided between the reductant injector housing 16 and the receiver tube 14. The injector housing 16 is held against the junction insulation 34 by the layer of thin foil 32. The reductant injector housing 16 is preferably hydroformed or stamped, and is thicker than the thin foil layer 32 that is welded, adhered to, or otherwise joined to the upper connection surface 33 of the base flange 24. The reductant injector housing 16 is preferably between about 0.8 mm thick and about 2.7 mm thick, and preferably 1.2 mm thick and made of stainless steel, which is relatively thick and rigid compared to the thin foil 32, as used in this invention. The thin foil 32, on the other hand, is less than about 0.8 mm [0.031"], and preferably between about 0.17 mm [0.006"] and about 0.20 mm [0.008"] thick and made of stainless steel, or other formable metal. Embossment and other manufacturing processes can reduce or increase the foil thickness, particularly in localized areas, so the term "about" in reference to thin foil thickness, as used herein, refers to the dimensions of the foil 32, but subject to changes from manufacturing processes. For example, embossment of thin foil 32 as seen in FIG. 11, can thicken the foil to about 0.35 mm [0.014"] to about 0.41 mm [0.016"] at the embossments.

The base flange 24 of the reductant injector housing 16 is not directly connected to the decomposition tube 14, the injector tube 15, or the junction 17. Instead, it bears on the tube insulation 30, and is spaced apart from the receiver tube 14. The base flange 24 is wide enough to distribute loads on the tube insulation 30 and further provides a connection surface 33 (optionally on the upper or lower side of the base flange 24) to which the layer of thin foil 32 can be welded, preferably by resistance welding. Alternatively, this connection between the base flange 24 and the thin foil 32 could be done with other types of welds utilizing filler materials, brazing, or adhesives. The reductant injector housing 16 provides rigidity to prevent denting during service and installation of the reductant injector 13, for example. The injector housing 16 also includes a receptacle portion 26 that defines an insulation space 35 into which junction insulation 34 can be packed to insulate around the injector junction 17, thus minimizing the temperature drop across the injector tube 15 and the junction 17 with the decomposition tube 14 to improve performance. Additionally, the housing 16 eliminates the need for stamp tooling the thin foil layer 32 to specific contours around the injector, so it can be universally implemented for a specific tube injection configuration.

Figure 5:
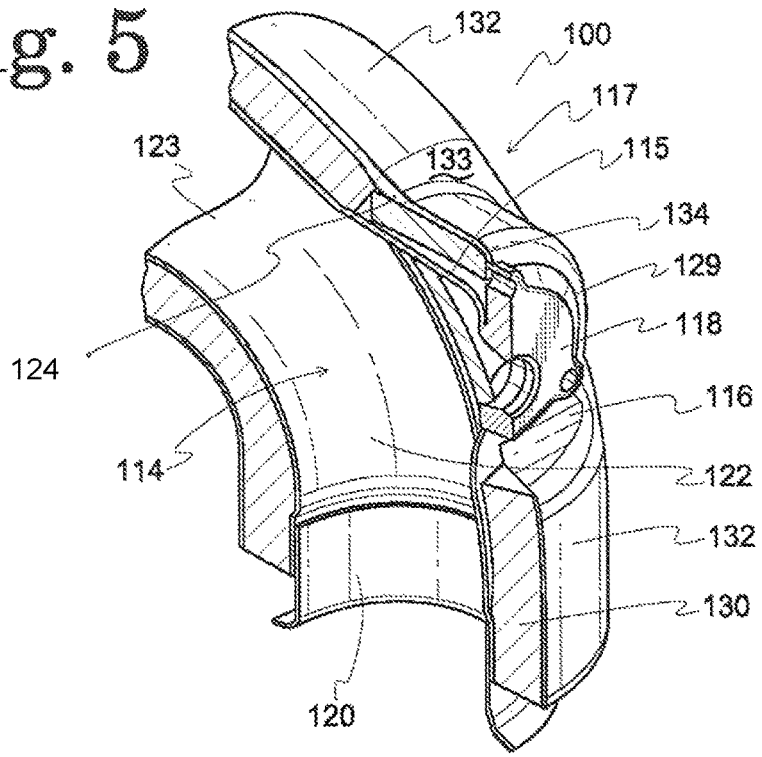
FIG. 5 shows a partial cross-sectional view of an embodiment of a curved decomposition tube assembly.

A curved decomposition tube assembly 100 is illustrated in FIG. 5. In this embodiment, the tube junction housing/reductant injector housing 116 is provided on the outer bend of a receiver tube/decomposition tube 114 where the injector tube 115 joins the receiver tube 114 at a junction 117. Like the embodiment of FIGS. 1 through 4, the assembly 100 includes a layer of tube insulation 130 around receiver tube 122 and additional junction insulation 134 is provided between the reductant injector housing 116 and the receiver tube 122. The reductant injector flange 118 is either welded directly to the injection tube 115 or is integral with and cast from the same material as the injection tube 115 and the decomposition tube 114. Like the embodiment of FIGS. 1 through 4, the curved decomposition tube assembly 100 also includes a layer of thin foil 132 substantially surrounding the tube insulation 130. Like the previously described embodiments, the injector housing 116 is not connected directly to the decomposition tube 114, the junction 117, or the injector tube 115, and instead bears on the tube insulation 130 and/or the thin foil 132, and is joined to the thin foil 132.

As stated above, the injector housing 16, 116 connection surface 33/133 can be on the top or the bottom of the base flange 24/124, so that the base flange 24/124 can be placed above the thin foil 32/132 rather than below the thin foil 32/132. The injection housing 16/116 can also be used in conjunction with other insulation enclosures, such as foil tapes, elastic wraps, or woven/knitted materials for encapsulating insulation.

As stated above, the embodiments illustrated in FIGS. 1 through 5 are related to exhaust after-treatment systems, but the present invention is not limited to this field. The present invention of a stamped pad/housing could be used in conjunction with thin foil to insulate around any complex geometry. For example, the present invention can be implemented with sensor couplings, hydrocarbon injectors, bracketed tubes, aspirator tubes or other complex shapes into which thin foil cannot be stamped, or attached.

Figure 8:
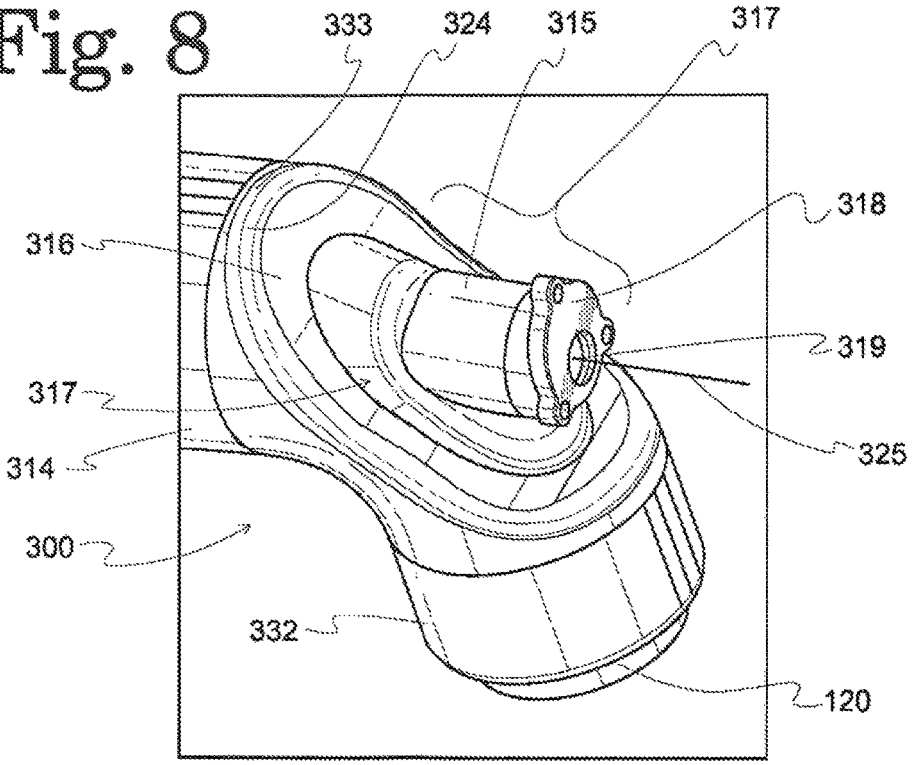
FIG. 8 shows a perspective view of hydroformed tube junction housing used for affixing thin foil around an injector port in a different configuration according to an alternative embodiment of the invention.
Figure 6:
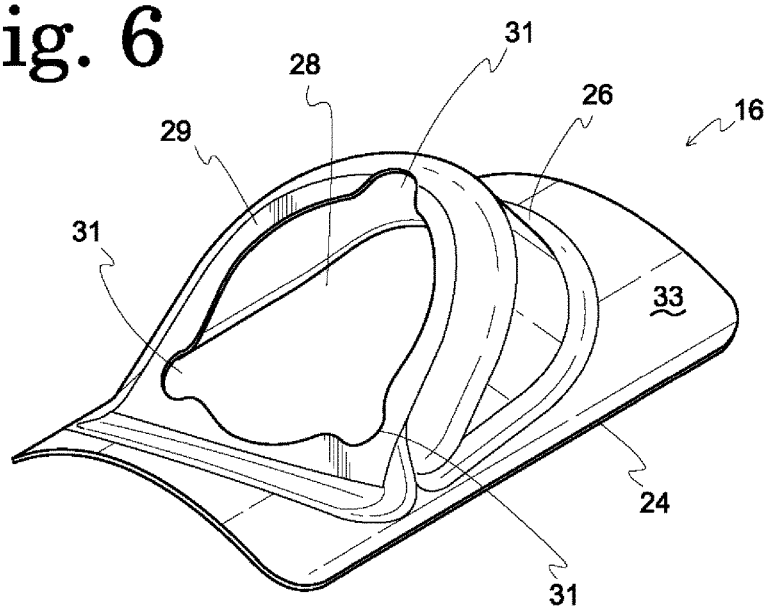
FIG. 6 shows a perspective view of a tube junction housing of the embodiment of FIG. 1.
Figure 7:
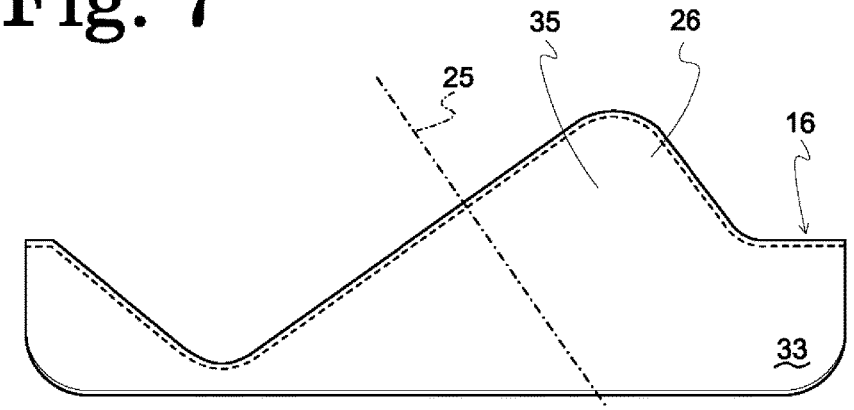
FIG. 7 shows a cross-sectional view of the tube junction housing of FIG. 6.

Examples of additional alternative embodiments are illustrated in FIGS. 8 through 10.

FIG. 8 shows a perspective view of hydroformed pad system 300 having a hydroformed housing 316 used for affixing thin foil 332 around an injector port 319 in the injector flange 318, and a different configuration that does not completely cover or insulate the junction 317 between the merging tubes 314 and 315, but provides a base to which the thin foil 332 can be joined. Also, illustrated in FIG. 8 are: a base flange 324 on the housing 316 and an injector axis 325 defined by the injector tube 315.

FIG. 9 shows a cross-sectional view of an insulated aspirator tube system 200 having an aspirator tube 215 joined to a receiver tube 214 at a junction 217. Thin foil 232 encapsulation is provided around the receiver tube 214. FIG. 10 shows the assembly 200 from FIG. 9 prior to insulation to illustrate the use of pad/housing 216 around the aspirator tube 215 to aid in affixing thin foil 232 around the tube insulation 230. The housing 216 is not directly affixed to the receiver tube 214, aspirator tube 215, or the junction 217, but instead is able to slide ("float") relative to the aspirator tube 217 while bearing on the tube insulation 230. Such an arrangement permits the housing 216 to be secured to the thin-foil 232 and bear on the tube insulation 230 to improve the insulation properties around the junction 217.

Nothing in the above description is meant to limit the invention to any specific formulation, calculation, or methodology. Many formulation, calculation and methodology substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the described invention. Accordingly, it is understood that the drawings and the descriptions herein are proffered only to facilitate comprehension of the invention and should not be construed to limit the scope thereof.

The invention claimed is:

1. A tube junction assembly comprising:

a receiver tube defining a receiver tube axis;

tube insulation substantially surrounding the receiver tube; and a thin foil spaced apart from the receiver tube and substantially surrounding the tube insulation;

an injector tube joined to the receiver tube at a tube junction and defining an injector tube axis; and a tube junction housing having;

a receptacle portion defining an insulation space, and an injector opening, and a base flange joined to the receptacle portion and including a thin foil connection surface joined to the thin foil, and the base flange rests on the tube insulation and is spaced apart from the receiver tube.

2. The tube junction assembly of claim 1, wherein the base flange is substantially arcuate relative to, and spaced apart from, the receiver tube axis.

3. The tube junction assembly of claim 2, wherein the injector tube axis and the receiver tube axis are disposed to define an angle of less than 90°.

4. The tube junction assembly of claim 1, wherein the receptacle portion includes a lip defining connector openings.

5. The tube junction assembly of claim 1, wherein the base flange extends outwardly from the receptacle portion.

6. The tube junction assembly of claim 1, and further comprising:

an injector flange disposed in the receptacle portion adjacent to and substantially co-planar with the injector opening.

7. The tube junction assembly of claim 1, and further comprising:

junction insulation disposed in the insulation space.

* * * * *